United States Patent [19]

Kashiwara et al.

[11] 4,401,915

[45] Aug. 30, 1983

[54] IGNITION PLUG FOR AN INTERNAL COMBUSTION ENGINE

[76] Inventors: Takeaki Kashiwara; Ryohei Kashiwara; Hideaki Kashiwara, all of 5-chome 39 No. 3 Yamasaka-cho, Higashisumiyoshi-ku, Osaka, Japan

[21] Appl. No.: 251,546

[22] Filed: Apr. 6, 1981

Related U.S. Application Data

[63] Continuation of Ser. No. 974,181, Dec. 28, 1978, abandoned.

[30] Foreign Application Priority Data

Dec. 28, 1977 [JP] Japan ..... 52-159822
Sep. 29, 1978 [JP] Japan ..... 53-121107

[51] Int. Cl.[3] ..... H01T 13/20
[52] U.S. Cl. ..... 313/142
[58] Field of Search ..... 313/139, 141, 142

[56] References Cited

U.S. PATENT DOCUMENTS

| | | | |
|---|---|---|---|
| 1,371,488 | 3/1921 | Jacobson | 313/139 |
| 2,129,003 | 9/1938 | Grant | 313/139 X |
| 2,391,459 | 12/1945 | Hensel | 313/139 |
| 2,944,178 | 7/1960 | Schaub | 313/141 |
| 3,970,885 | 7/1976 | Kasima | 313/141 |
| 4,023,058 | 5/1977 | Lara et al. | 313/141 X |

FOREIGN PATENT DOCUMENTS

| | | | |
|---|---|---|---|
| 187501 | 10/1922 | United Kingdom | 313/169 |

*Primary Examiner*—Palmer C. Demeo
*Attorney, Agent, or Firm*—Fisher, Christen & Sabol

[57] ABSTRACT

A spark plug for internal combustion engines is provided with a ground electrode which terminates below the center electrode and is provided with one or more vertical openings to facilitate the passage of ignited gases from the area of the spark to the area of the piston. A single elongated opening may be provided or there may be one or more small openings spaced along the length of the electrode. The area adjacent the opening may be outwardly and downwardly tapered to concentrate and speed the flow of gases.

7 Claims, 21 Drawing Figures

IGNITION PLUG FOR AN INTERNAL COMBUSTION ENGINE

This application is a continuation of copending application Ser. No. 974,181, filed Dec. 28, 1978, and now abandoned.

BACKGROUND OF THE INVENTION

The present invention relates to an improvement in a spark plug for internal combustion engines.

In the conventional spark plug, a generally L-shaped ground electrode is welded at one end to the lower skirt margin of the threaded shell of the plug, so that the free end of the ground electrode ties just below the exposed end of another electrode which is supported concentrically in the shell within a cylindrical block of insulating material. The ground electrode usually consists of a solid flat bar of metal so that when the gaseous fuel is ignited by a spark across the gap between the two electrodes, a portion of the expanding gas is blocked in its passage towards the piston by having to pass around and over the sides of the ground electrode. This delayed passage results in imperfect combustion of the gases and contributes appreciably to pollution when one considers the frequency of the explosions taking place in each cylinder of a modern engine.

BRIEF DESCRIPTION OF THE INVENTION

It is an object of the invention to provide the ground electrode with one or more openings through which the exploding gases may more expeditiously pass from one point of ignition to the piston side of the ground electrode. This equalizes the pressure of the expanding gases on the piston and by providing a shorter path for the gases to travel, reduces imperfect combustion, increases efficiency and reduces pollution.

Another object of the invention is to provide what amounts to a collection area on the piston side of the ground electrode around the opening therein which acts to concentrate and increase the velocity of the exploding and expanding gases as they pass the ground electrode on their way toward the piston, thereby accelerating complete combustion.

Other objects and advantages will be apparent to those skilled in the art after reading the following specification and claims in connection with the annexed drawings.

BRIEF DESCRIPTION OF THE DRAWINGS

FIG. 13 shows an enlarged sectional view of an essential portion of one example of the second embodiment;

FIG. 14 shows a base view of FIG. 13;

FIG. 15 shows an enlarged partial view from line A—A of FIG. 13;

FIG. 16 shows an enlarged partial view from line B—B of FIG. 13;

FIG. 17 shows an enlarged sectional view of the essential portion of a further modification;

FIG. 18 shows a bottom view of FIG. 17;

FIG. 19 shows an enlarged partial view from line D—D of FIG. 17; and

FIG. 21 shows another example of FIG. 20.

DETAILED DESCRIPTION OF THE INVENTION

Figure 1:
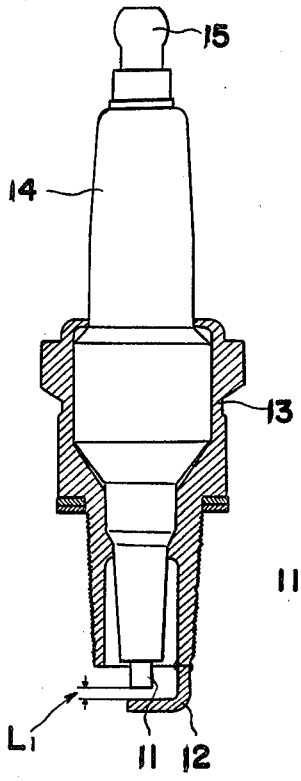
FIG. 1 is a vertical cross section of a typical spark plug of the prior art.
Figure 2:
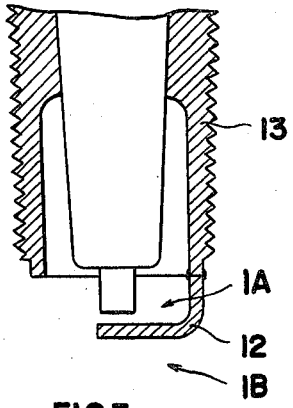
FIG. 2 is a fragmentary lower section of FIG. 1 on an enlarged scale.
Figure 3:
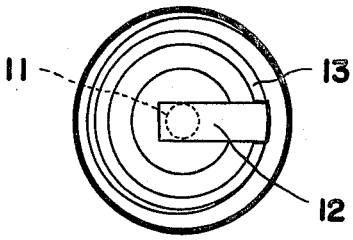
FIG. 3 is a bottom view of FIG. 2.

The conventional spark plug of the prior art is show in FIGS. 1–3 in which an L-shaped metal ground electrode 12 is welded to the lower margin of the threaded metallic shell 13 which concentrically supports the center electrode 11 by means of the insulating material 14. When the internal combustion engine is operating a source (not shown) of electromotive energy connected to terminal 15 intermittently creates a spark across the gap L, (usually about 0.7 mm) to explode the fuel within the cylinder. In the usual plug the electrode 12 comprises a flat bar, or plate, having flat upper and lower surfaces so that when the ignition occurs in the space 1A the exploding fuel must travel around both sides of electrode 12 in order to reach the space 1B on the piston side of the electrode which causes a momentary delay. This causes an irregular increase in the resulting gas pressure in the cylinder and reduces the efficiency of the engine. In view of the high rotational speeds of these engines and the short interval of time of duration of each spark the result is an incomplete combustion of gases, which increases with the speed of the engine. This also contributes to environmental pollution.

Figure 4:
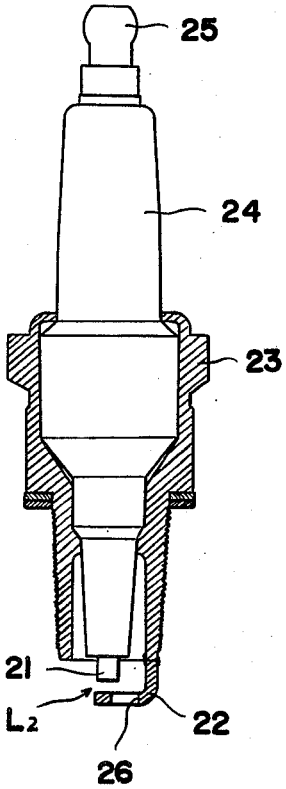
FIG. 4 is a vertical section of a preferred form of spark plug according to this invention.
Figure 5:
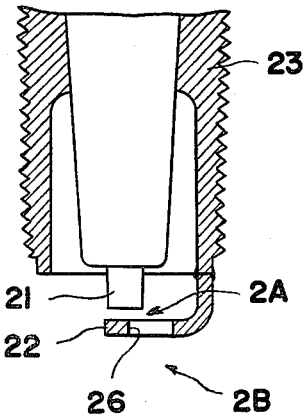
FIG. 5 shows an enlarged sectional view of the lower part of FIG. 4.
Figure 6:
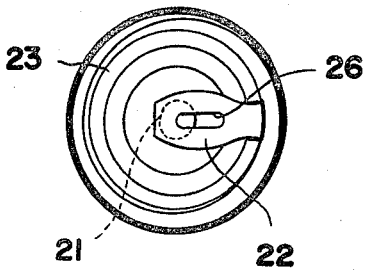
FIG. 6 shows an enlarged bottom view of FIG. 5.

In a preferred embodiment of the present invention, as shown in FIGS. 4–6, the flat-surfaced, L-shaped ground electrode 22 is welded to the bottom margin of metallic shell 23 so that its free end defines, with center electrode 21, the gap $L_2$. As in the case of the prior art, an electromotive force is intermittently applied to the terminal 25 to energize electrode 21 which is concentrically supported in the shell 23 by means of insulator 24, to ignite and explode mixed fuel in the cylinder (not shown).

The free end of electrode 22 is provided with an elongated opening 26, one end of which is generally in alignment with the center of electrode 21. Thus, when a spark initiates an explosion in the space 2A (FIG. 5) the explosive gases will pass, not only around the sides of electrode 22, but also simultaneously through the opening 26 to the space 2B on the piston side of the electrode. The spread of the explosion is therefore not delayed and nearly perfect combustion in the cylinder is achieved even when the engine is rotating at high speed. Further, the higher the speed of the engine the more heated does the ground electrode 22 become, and the total width of the electrode is increased, over the width of the conventional electrode, by an amount approximately equal to the width of opening 26 so that the heat retaining capacity of the electrode remains about the same. This means that weaker fuels may be used in proportion to the increase in temperature even if a rich fuel (produced by "choking" the air inlet) is required for starting. Therefore, fuel economy and nearly perfect combination can be expected. The opening 26 will not become clogged, due to the high velocity of explosive gases passing through it, and conditions for producing the best spark are maintained.

Figure 7:
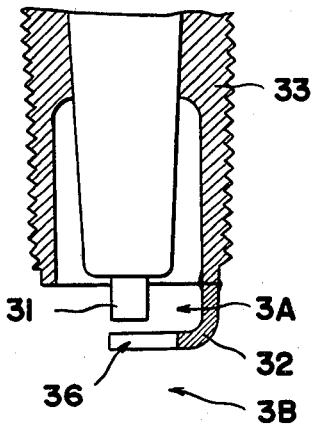
FIG. 7 and FIG. 8.
Figure 8:
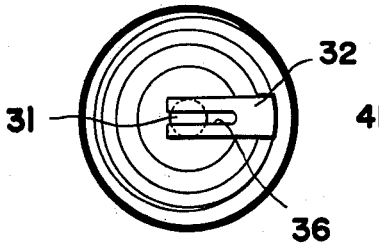

FIGS. 7 and 8 show another form of the above modification, in which the gas opening 36 extends through the margin of the free end of ground electrode 32 which has its other end attached to metallic shell 33. Since the elongated opening extends entirely across the center electrode 31, the rate of passage of the gases from the ignition space 3A to the space 3B on the piston side is increased.

Figure 9:
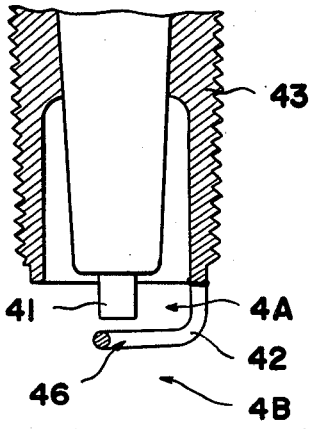
FIG. 9 and FIG. 10, and FIG. 11 and FIG. 12 show other examples of the first embodiment respectively.
Figure 10:
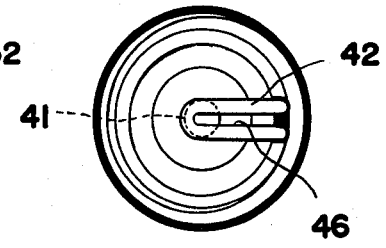

FIGS. 9 and 10 illustrate another form of the first embodiment of the invention in which the ground electrode 42 comprises a metallic rod which is first bent in the form of a "U" to define an elongated gas opening 46. The two legs of the U-shaped rod are also bent to form an L-shaped electrode with the ends of the rod welded to the shell 43. Due to the fact that the opening extends from a location across the center electrode 41 all the way up to the margin of the shell 43 the rate of passage of gases from space 4A to 4B is increased. Another advantage is that this electrode is easily produced.

Figure 11:
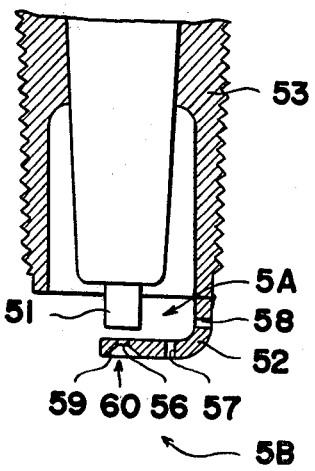
Figure 12:
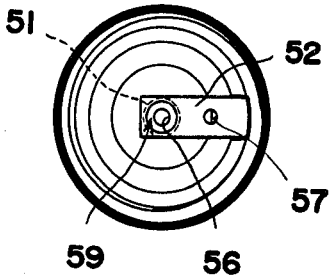
Figure 13:
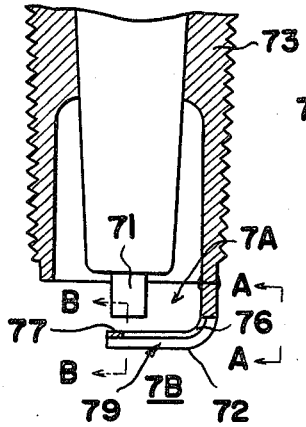
FIG. 13 to FIG. 21 show the second embodiment of the present invention.
Figure 15:
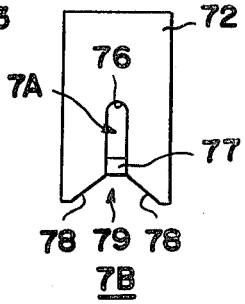
Figure 17:
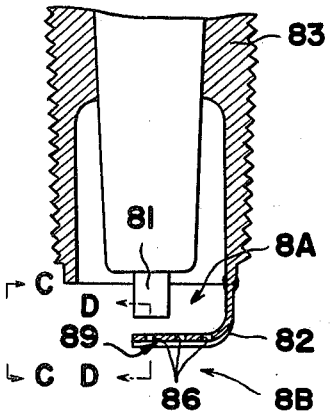
Figure 14:
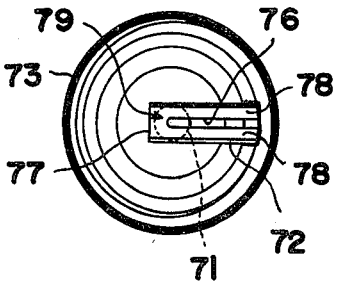
Figure 16:
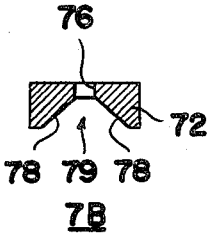
Figure 18:
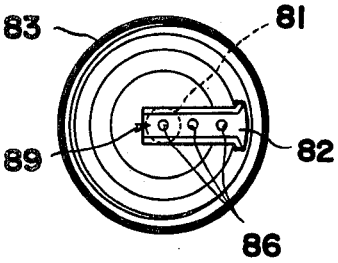
Figure 19:
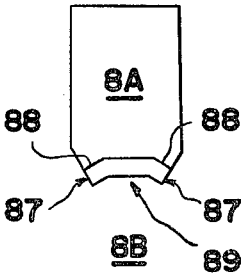
Figure 20:
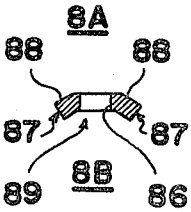

FIGS. 11 and 12 show still another example of the first embodiment, wherein the ground electrode 52, attached to the shell 53, is provided with a series of gas passages 56, 57 and 58. The opening 56 is generally in alignment with the center electrode 51, while the opening 57 is nearby in the horizontal portion and opening 58 is in the vertical leg portion. This series of openings performs a function similar to that of the elongated single opening of the plug of FIGS. 9 and 10 in expediting the passage of gases from space 5A to space 5B.

Further, the opening 56 may be provided with a concentrating area, indicated by numeral 60, defined by the outwardly, downwardly tapered surface 59 surrounding it. A portion of the spreading gas from the area 5A is further spread to the mixed fuel in the collecting area 60 as it passes through opening 56 and, when reflected by the tapered surface 59, its expansion is accelerated toward the area 5B on the piston side of the electrode to explode all of the fuel in the chamber. As a result the explosive forces are equalized, the efficiency of the engine is increased, environmental pollution is reduced and a self-cleaning effect is produced on the ground electrode.

Further, the concentrating area 60 might be formed as a section of a cylinder, instead of in the form of a cone, as will be shown in another embodiment. Since the thickness of the electrode adjacent the opening 56 is thinner than the remainder of the electrode, this portion will tend to radiate heat which promotes easier ignition by increasing evaporation of fuel.

Since the foregoing forms of the invention promote more rapid passage of gases from the location of the spark to the piston, because they travel simultaneously around, and through the openings in, the electrode, the spread of gases is not delayed by the presence of the ground electrode, as in the prior art devices. Since in this modification the tapered surfaces concentrate and accelerate the spread of gases through the openings to the piston side there is substantially instant, and complete, combustion.

Another embodiment of the invention is shown in FIGS. 13–21. One example of this embodiment is shown in FIGS. 13–16, wherein an L-shaped ground electrode plate 72 is welded to the metallic shell 73, with its free end spaced below the center electrode 71. An elongated opening 76 extends from a point near the free end and about halfway up the vertical portion to expedite the flow of exploding gases from the area 7A to area 7B on the piston side. The walls 78, on both sides along the length of the opening, are outwardly tapered in the direction of gas flow and a concentrating area 79 is formed therebetween.

Thus, at the time the spark is produced in the gap between electrodes 71 and 72, the mixed fuel spreads explosively around in the area 7A and simultaneously spreads to the fuel in the concentrating area 79 through the opening 76.

At the time of the explosion of fuel in the area 79, the power of the expanding gas is converted to a physical force of velocity to accelerate the gas toward the piston side area 7B as a result of reflection from the tapered surfaces 78. Thus, a mixed fuel of imperfectly combusted gas in the area 7B is ignited at the same time as the ignition in the area 7A of the spark. This means that the accelerated spreading of the original ignition completes substantially perfect combustion of the mixed fuel in the shortest time.

FIGS. 17–20 illustrate another example of the second embodiment of the invention, in which the ground electrode 82 is formed from a strip of metal by bending it to shape. One end is welded to the metallic shell 83 so as to position the other end spaced below the center electrode 81 to form the plug gap. In this electrode 82, a plurality of gas openings 86 are provided in the plate-shaped metal extending from the spark area 8A to the piston side 8B and are disposed along the center of the plate. In this case the opposing margins 87 of the plate are bent downwardly to form a concentrated area 89 connected with the openings and facing the piston side area 8B. According, the upper surfaces of the margins 87 are also inclined downwardly with respect to the cylinder.

The results obtained in the operation of this example of the invention are generally similar to those obtained in the case of the previous example of FIGS. 13–16.

In this example, because the tapered surfaces 88 are not formed by machining, or otherwise removing of metal, but are formed by bending, manufacture is relatively simple and the electrode 82 can be formed from thin plate. This means that operation differs from the previous examples in that the exploding gases are directed from area 8A downwardly by both the upper and lower surfaces of the tapered margins 88, so that the spreading of the ignition to the incompletely combusted gases on the piston side can be completed. The result is that the fuel combustion in the cylinder is more equalized to complete the combustion by the spreading of ignition in two directions, one being directly to the piston side area 8B, the other being toward the inner wall of the cylinder.

Figure 21:
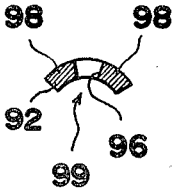

FIG. 21 illustrates a variation of the previous example in which the ground electrode 92 is bent in a form having an arcuate cross section with a plurality of gas openings 96. The results are similar to that of the previous example, the arcuate margins 98 defining a concentrating area 99 to induce complete combustion.

Since the invention according to the second embodiment includes a concentrating area on the piston side of the ground electrode which is directly connected with the spark side of the electrode, at the time of the spark the combustion of the mixed fuel spreads simultaneously through the opening, or openings, in the electrode. As the fuel explodes in the concentrating area the forces of expansion are transformed to physically speed the gases toward the piston as a result of the shape of the tapered surfaces on the ground electrode. Therefore, imperfectly combusted gases on the piston side are ignited simultaneously with ignition on the spark side with early combustion which prevents environmental pollution in the exhaust gases with consequent efficient operation and economical fuel consumption.

Although the invention has been described in its preferred form with a certain degree of particularity, it is understood that the present disclosure of the preferred form may be changed in the details of construction and the combination and arrangement of parts without departing from the spirit and the scope of the invention as hereinafter claimed.

What we claim is:

1. A spark plug for an internal combustion engine having a grounded outer cylindrical shell and an axially extending centrally positioned insulated electrode, an elongated ground electrode extending radially inwardly from said outer shell with its free end positioned at a location spaced a short axial distance away from the end of said insulated electrode, the width of the ground electrode along its length in a direction at right angles to the axis of the shell being substantially greater than its thickness in the axial direction and being provided with at least one opening extending axially therethrough, the surface of said ground electrode on the side facing away from the end of said insulated electrode being generally concave in transverse cross section along the length thereof.

2. The spark plug as defined in claim 1, wherein said opening in elongated along the length of the ground electrode.

3. The spark plug as defined in claim 2, wherein said ground electrode is L-shaped and said opening extends upwardly along the vertical portion of the electrode.

4. The spark plug as defined in either claim 2 or 5, wherein said opening extends through the end margin of the free end of the electrode.

5. The spark plug as defined in claim 1, wherein said ground electrode is formed from relatively thin metal having an arcuate downwardly concave transverse cross-section.

6. The spark plug as defined in claim 1, wherein said opening is circular and is disposed in alignment with said central electrode.

7. The spark plug as defined in claim 1, wherein said ground electrode is provided with a plurality of openings spaced from each other along the length of the electrode.

* * * * *